United States Patent [19]

Johnson et al.

[11] Patent Number: 4,538,723

[45] Date of Patent: Sep. 3, 1985

[54] BATTLEFIELD MAGAZINE

[75] Inventors: Bruce S. Johnson; Paul H. Borst, both of Dallastown, Pa.

[73] Assignee: Harsco Corporation, York, Pa.

[21] Appl. No.: 643,189

[22] Filed: Aug. 22, 1984

[51] Int. Cl.[3] ..... F42B 37/00

[52] U.S. Cl. ..... 206/3; 206/443

[58] Field of Search ..... 206/3, 443, 323, 446, 206/583

[56] References Cited

U.S. PATENT DOCUMENTS

| | | | |
|---|---|---|---|
| 1,120,244 | 12/1914 | Sachtleben | 206/3 |
| 1,991,481 | 2/1935 | Woodbridge | 206/3 |
| 2,371,663 | 3/1945 | Woodberry et al. | 206/3 |
| 3,185,035 | 5/1965 | Humphries | 206/3 |
| 3,515,321 | 6/1970 | Webster | 206/3 |
| 3,710,677 | 1/1973 | Mayer | 206/3 |
| 4,222,484 | 9/1980 | Howe | 206/3 |
| 4,286,708 | 9/1981 | Porzel | 206/3 |
| 4,356,913 | 11/1982 | Moraine | 206/3 |

*Primary Examiner*—Joseph Man-Fu Moy

*Attorney, Agent, or Firm*—Kerkam, Stowell, Kondracki & Clarke

[57] ABSTRACT

A battlefield magazine includes a base and a cover which may be used to realize a projectile storage container to protect projectiles against harsh environmental conditions and to seal projectiles against contamination from nuclear, biological, and chemical agents. Each of the projectiles within the projectile storage container is individually sealed by a resilient seal compressed between the cover and the base. When access to the projectiles for usage is required, the cover may be removed from the base and replaced with an alternate projectile front protecting device used to lock the front of the projectiles. The projectile locking front together with the base form a projectile storage rack used to secure the projectiles, but also allowing their removal for loading into weapons.

27 Claims, 16 Drawing Figures

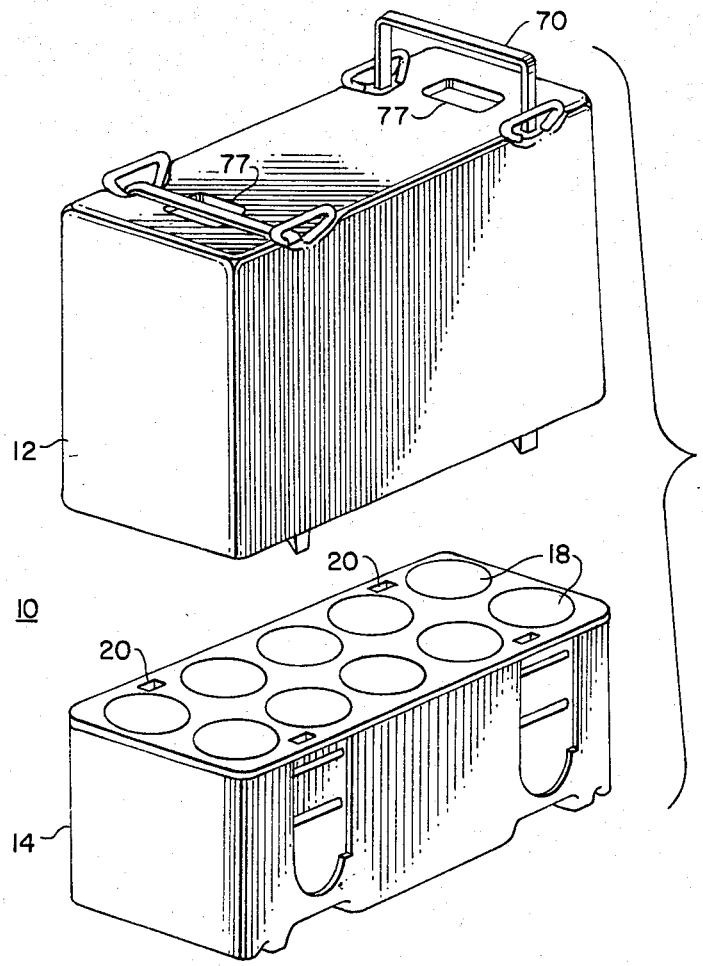
FIG. 1.
FIG. 2.
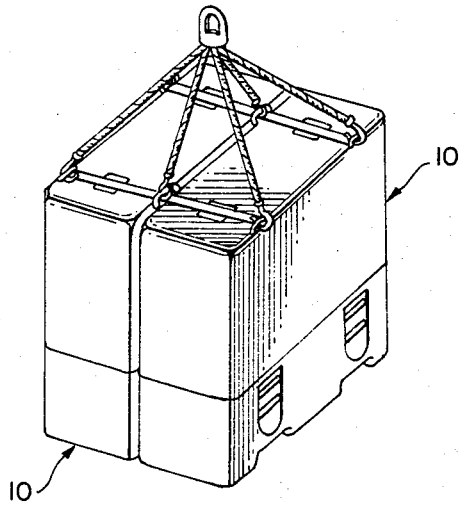
FIG. 3.
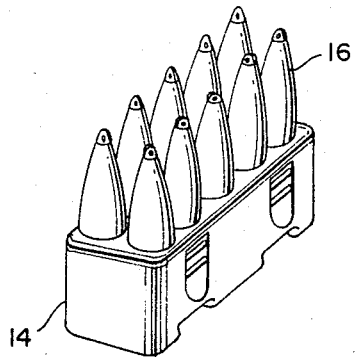

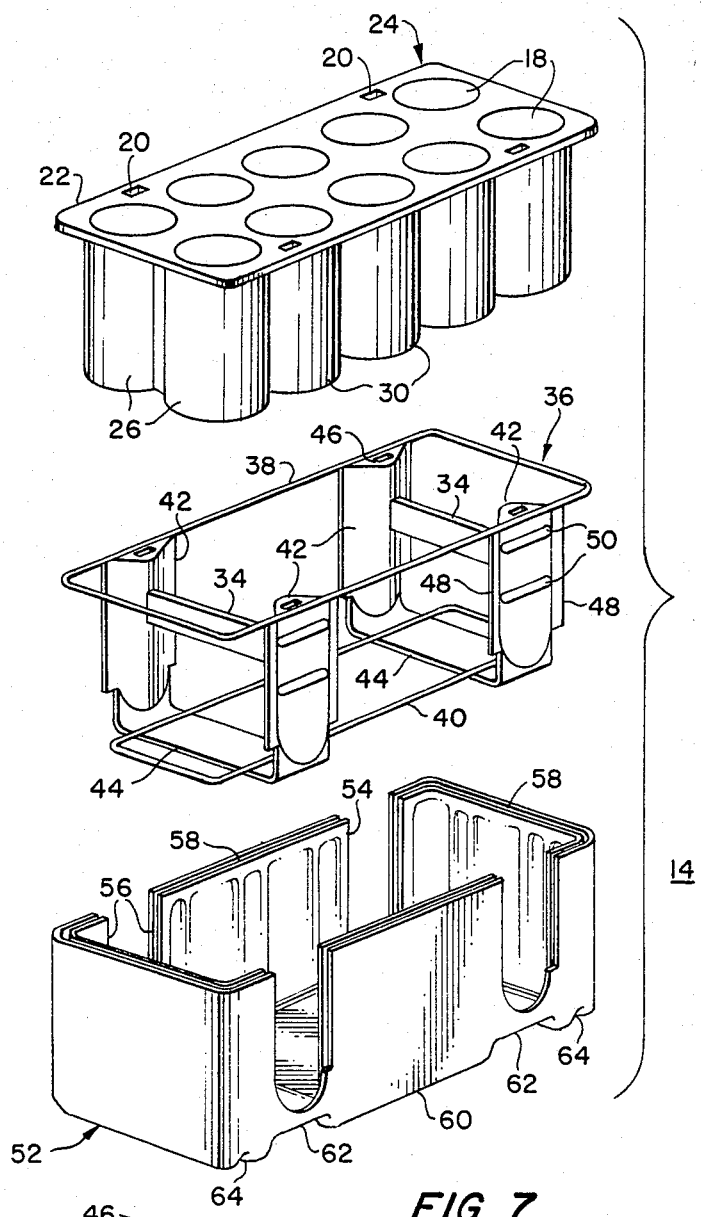
FIG. 4.
FIG. 7.
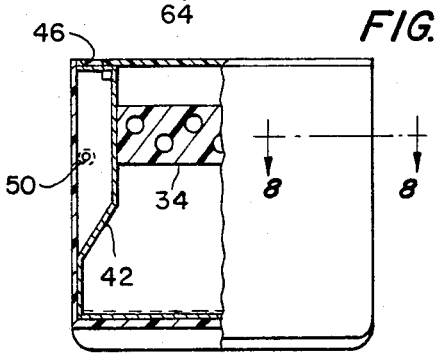
FIG. 8.
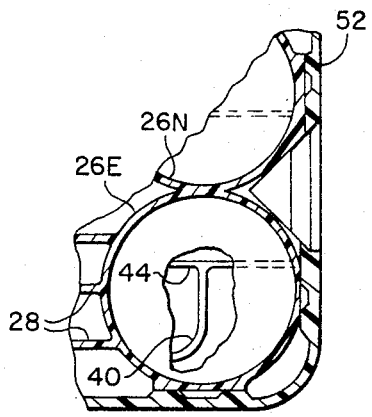

BATTLEFIELD MAGAZINE

BACKGROUND OF THE INVENTION

The present invention relates to magazines for carrying and/or storing projectiles.

The modern war is often a war of logistics where the winner is determined by the ability to efficiently transport men and material. Accordingly, it is essential to optimize the conveyance of ammunition such as projectiles and shells.

For simplicity, "projectiles" as used herein shall be considered to include shells, missiles, torpedoes, bombs, and more generally ammunition.

The storage or transportation of projectiles generally requires a balancing between two conflicting considerations. On the one hand, the projectiles should be stored such that it is easy to remove them from their storage mechanism as required for usage of the projectile. On the other hand, the projectiles must be stored such that they are secure in their storage arrangement and will not be jarred loose by nearby explosions or while being transported along a bumpy road. Generally, the more secure a projectile is from accidental dislodgement, the more time-consuming it is to remove the projectile from its storage facility.

One common method for transportation and storage of projectiles is by use of a wooden pallet. The pallet is normally configured in two rows of four projectiles. The wooden pallet consists of upper and lower wood laminates held together with steel banding. The bases of the projectiles rest on the lower wood laminate board and the nose protrudes through holes drilled in the top wood laminate board.

The use of wooden pallets is subject to numerous disadvantages. For one thing, the steel banding must be cut or otherwise removed to allow access to all of the projectiles, this in turn necessitating the rebanding of the wooden pallet if the projectiles are to be resecured. Further, the pallet does not protect the projectiles from incidental mechanical damage or from a contaminated environment (storage under high humidity or other harsh conditions or nuclear, biological, or chemical agents). Accordingly, the projectiles require periodic maintenance at considerable expense or likewise expensive decontamination where enemy action has resulted in nuclear, biological, or chemical agents contaminating the outside of the projectiles. In order to maintain or decontaminate the projectiles, the pallet must be broken apart. The projectiles must then be treated to protect them from environmental deterioration and/or to decontaminate them. The projectiles must then be replaced upon the pallet and the upper and lower boards of the pallet must be rebanded together. A further disadvantage of the wooden pallet method is that the projectiles must be removed from the pallets in order to allow them to be readied for usage by placement within an ammunition resupply vehicle such as that disclosed in the U.S. Pat. No. 4,236,441 entitled "Field Artillary Ammunition Support Vehicle" issued on Dec. 2, 1980 to John Turner, Richard A. Koster, and Seymour Bassman, and assigned to the assignee of the present application.

Some of the prior art problems with storage and transportation of projectiles have been overcome by the Projectile Lock Assembly disclosed in U.S. Pat. No. 4,344,528, issued Aug. 17, 1982 to Ayyala Perisastry, Richard A. Vishe, and Peter J. Hoet. The projectile lock assembly disclosed in that patent, which is assigned to the assignee of the present invention, uses a rack having a plurality of parallel cylindrical tubes. A number of locking assemblies are mounted along each of the tubes and used for individually locking projectiles within the associated tube.

Although the projectile lock assembly of the Perisastry et al patent is extremely useful in providing a storage rack for projectiles, its structure is sufficiently complex as to make it most practical under conditions where projectiles must be separately removed from a storage rack. That is, it is quite useful in an ammunition resupply vehicle where projectiles must be normally secured during the vehicle's movement and selectively removed from projectile storage zones as necessary for conveyance to a self propelled howitzer or other weapon. However, the expense and complexities of the locking structure generally would preclude its use for transportation of projectiles except where individual projectile access is required (i.e., at or near the battlefront where projectiles are fused and/or loaded into weapons).

As will be readily appreciated, the transfer of projectiles from a wooden pallet to the projectile rack and lock assembly as disclosed in the Perisastry et al patent adds a time consuming step to the overall process of most efficiently getting projectiles from the factories and/or long term storage depots to the racks from which the projectiles may be stored and conveyed under battlefield conditions.

OBJECTS AND SUMMARY OF THE INVENTION

Accordingly, it is a primary object of the present invention to provide a new and improved battlefield magazine.

A more specific object of the present invention is to provide a battlefield magazine which may be used for projectile storage and conveyance under front line conditions as well as long term storage.

A further object of the present invention is to provide a battlefield magazine which may realize a projectile locking function under battlefield conditions as necessary, but which need not include the projectile locking feature when being used in long term storage or other conditions where projectile locking is not necessary or economically advisable.

Yet another object of the present invention is to provide a battlefield magazine which will protect projectiles from deterioration under harsh environmental conditions such as high humidity and which will protect projectiles from contamination due to enemy action by way of nuclear, chemical, and biological agents.

A still further object of the present invention is to provide a battlefield magazine which is relatively light in weight and simple in construction.

Yet another object of the present invention is to provide a battlefield magazine which is easy to operate for securing and releasing projectiles as desired.

The above and other objects of the present invention which will become apparent as the description proceeds are realized by an apparatus comprising a projectile locking front including: a body having a front and a back; a plurality of projectile front storage zones in the body and extending from the back to the front, each of the front storage zones having an open back to allow projectiles to extend outwardly therefrom and an open front to allow projectiles to extend outwardly therefrom; locking means mounted to the body and selectively operable to secure projectiles against movement out the front of the front storage zones and selectively operable to allow projectile removal out of the front of the front storage zones; and base securing means on the body operable for removably securing a base to the back of the body, the base having a plurality of projectile back storage zones associated on a one-to-one basis with the front storage zones and operable to hold the backs of projectiles which have their noses extending into the projectile front storage zones. Preferably, each of the front storage zones is within a corresponding front storage tube of circular cross-section. The locking means includes a securing portion for each of the front storage zones, each securing portion selectively operable to prevent a projectile from moving out of one of the front storage zones. The invention further comprises a base for holding back portions of a plurality of projectiles and including: a back; a front parallel to the back of said base and having a plurality of projectile openings therein; four sides extending from the back of the base to the front of the base; and a plurality of separate projectile back storage compartments between the front of the base and the back of the base, the back storage compartments associated on a one-to-one basis with the projectile openings; and wherein the base is removably secured to the locking front by the base securing means. Each of the back storage compartments has a length and transverse dimension to be operable to hold a projectile with at least one-half of the ogive of the projectile extending out from the front of the base. The base further comprises securing means operable for removably securing a projectile front protecting device to the front of the base; and wherein the base is operable to secure alternate projectile front protecting devices to the front of the base, one of the front protecting devices being a cover which encloses at least the front one-half of ogives of projectiles extending out of the back storage zones, and wherein movement of all of the cover is necessary to allow removal of projectiles from the back storage zones; the other of the front protecting devices being the projectile locking front. The base and the cover are together operable to compress at least one resilient seal disposed therebetween and to protect a plurality of projectiles against nuclear, biological and chemical agents. Each of the back storage zones is isolated from the other back storage zones. The base includes a plastic outer molding, a plastic inner molding, and a metal insert frame in between the plastic outer molding and the plastic inner molding; and wherein the plastic inner molding has a plurality of cylindrical tubes each of which defines one of the back storage zones.

The apparatus of the present invention may alternately be described as comprising a base for holding back portions of a plurality of projectiles and including: a back; a front parallel to the back and having a plurality of projectile openings therein; four sides extending from the back of the base to the front of the base; a plurality of separate projectile back storage compartments between the front of the base and the back of the base with parallel center lines, the projectile back storage compartments associated on a one-to-one basis with the projectile openings and each having a length and transverse dimension to be operable to hold a projectile with at least one-half of the ogive of the projectile extending out from the front of the base; and front securing means operable for removably securing a projectile front protecting device to the front of the base; and wherein the base is operable to secure alternate projectile front protecting devices to the front of the base; one of the front protecting devices being a cover which encloses at least the front one-half of the ogives of projectiles extending out from the back storage compartments, the base and the cover are together operable to compress at least one resilient seal disposed therebetween and to protect a plurality of projectiles against nuclear, biological, and chemical agents, and movement of all of the cover is necessary to allow removal of projectiles from the back storage compartments; the other of the front protecting devices being a projectile locking front having locking means selectively operable to secure projectiles against movement out of the back storage compartments and selectively operable to allow projectile removal from the back storage compartments with the projectile locking front disposed at the front of the base. Each of the back storage compartments is isolated from the other back storage compartments. The base includes a plastic outer molding, a plastic inner molding, and a metal insert frame in between the plastic outer molding and the plastic inner molding; and wherein the plastic inner molding has a plurality of circular cross-section tubes each of which defines one of the back storage compartments. The apparatus further comprises as cover operable to enclose at least one-half of the ogives of projectiles extending out from the base and including: a cover body having a closed off front, a back, four sides extending from the front to the back; a plurality of projectile front storage zones disposed in the cover body and extending from the back of the cover body to the front of the cover body; and back securing means operable with the front securing means for removably securing the cover to the base with the plurality of back storage compartments in the base corresponding on a one-to-one basis with the projectile front storage zones such that each front storage zone may hold the front of a projectile having its back extending into the corresponding back storage compartment. The apparatus further comprises a plurality of resilient seals disposed for compression between the cover and the base and corresponding on a one-to-one basis with the projectile openings; and wherein each back storage compartment and associated front storage zone together defines a projectile chamber isolated from other projectile chambers. The cover further includes at least one control on the cover body operable for activating and deactivating the securing means. The projectile locking front includes: a body having a front and a back; a plurality of projectile front storage zones in the body and extending from the back to the front, each of the front storage zones having an open back to allow projectiles to extend outwardly therefrom and an open front to allow projectiles to extend outwardly therefrom; locking means mounted to the body of the locking front and selectively operable to secure projectiles against movement out the front of the front storage zones and selectively operable to allow projectile removal out of the front of the projectile front storage zones; and base securing means on the body operable with the front securing means for removably securing the base to the back of the body of the locking front such that the back storage compartments correspond on a one-to-one basis with the front storage zones. The locking means includes a securing portion for each of the front storage zones, each securing portion selectively operable to prevent a projectile from moving out of one of the front storage zones. Each of the front storage zones is within a corresponding cylindrical front storage tube.

The apparatus of the present invention may alternately be described as a cover operable to enclose at least one-half of the ogives of projectiles extending out from a base and including: a cover body having a closed off front, a back, four sides extending from the front to the back; a plurality of projectile front storage zones disposed in the cover body and extending from the back to the front; back securing means operable for removably securing the cover to the base with a plurality of projectile back storage compartments in the base corresponding on a one-to-one basis with the front storage zones such that each front storage zone may hold the front of a projectile having its back extending into the corresponding back storage compartment; and at least one control on the cover body operable for activating and deactivating the back securing means; and wherein the cover and base are together operable to compress at least one resilient seal disposed therebetween and to protect a plurality of projectiles against nuclear, biological, and chemical agents. The apparatus may further comprise a base removably secured to the cover. The base is operable to secure alternate projectile front protecting devices to the front of the base; one of the front protecting devices being the cover; the other of the front protecting devices being the projectile locking front.

The method for storing projectiles and making them accessible for usage comprises the steps of: placing a plurality of projectiles in a projectile container having a base and a cover as described above, the projectiles being inaccessible with the cover on the base; and removing the cover when the projectiles are to be made ready for access; and securing a projectile locking front as described above to the base, the projectile locking front allowing access and removal of the projectiles while it is secured to the base.

BRIEF DESCRIPTION OF THE DRAWINGS

The above and other other features of the present invention will be more readily understood when the following detailed description is considered in conjunction with the accompanying drawings wherein like characters represent like parts through out the several views and in which:

FIG. 1 shows a perspective exploded view of a base and a cover of the present battlefield magazine.

FIG. 2 shows two battlefield magazines attached to a sling for ease of handling.

FIG. 3 shows a perspective view of the base of the present battlefield magazine with projectiles disposed therein.

FIG. 4 shows an exploded perspective view of parts of the base of the present battlefield magazine.

FIG. 7 shows a cross-section view taken along lines 7—7 of FIG. 6.

FIG. 8 shows a cross-section view taken along lines 8—8 of FIG. 7.

DETAILED DESCRIPTION OF THE PREFERRED EMBODIMENTS

Figure 13:
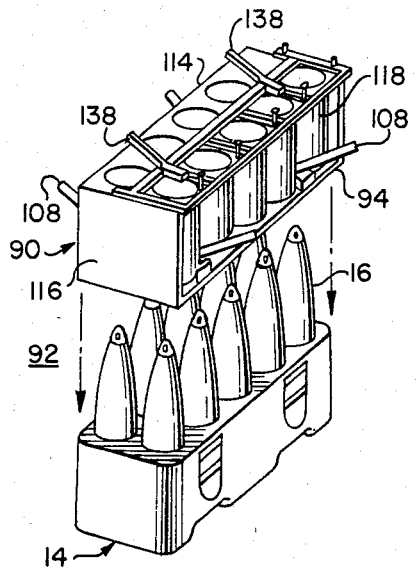
FIG. 13 shows a perspective view of the base and a projectile locking front of the present battlefield magazine prior to its attachment to the base.

Turning now to the perspective exploded view of FIG. 1, a projectile storage container 10 according to the present invention is shown. In particular, the projectile storage container 10 comprises a cover 12 and a base 14. Considering also the perspective view of FIG. 2, showing two of the projectile storage containers 10 strapped to a sling and FIG. 3, showing the base 14 with a plurality of projectiles 16 having their backs or tail sections disposed within the base 14, the basic purpose of the projectile storage container 10 will be readily understood. In particular, projectiles such as 16 may be loaded into the base 14 and the cover 12 may be attached to the front of the base 14 for conveying and/or long term storage of the projectiles 16 in the manner described in detail below. The base 14 is preferably constructed such that at least one-half of the ogives (the tapered front portions) of the projectiles extend forwardly out of the base 14.

Considering now FIG. 4 in conjunction with FIG. 1, the structure of the base 14 will be discussed in detail. FIG. 4 shows an exploded perspective view of various components of the base 14 of the present invention. The base 14 includes a two-by-five array of identically sized circular projectile openings 18 and four front securing holes 20. (For ease of illustration, the figures do not have labels for each of openings 18, holes 20, or other parts which include a plurality of like-constructed parts.) The openings 18 and holes 20 are disposed in a front plate 22 which is part of an inner plastic molding 24 also including a two-by-five array of projectile storage tubes 26. As best shown in the back (i.e., bottom view relative to the position of FIG. 4) view of FIG. 9, the plastic inner molding 24 further includes a series of webs 28 extending between the adjacent tubes 26. Although the tubes 26 are open at the projectile openings 18 at their fronts, the tubes 26 are closed at their backs 30. A number of channels 32 are disposed in numerous of the backs 30. There is slightly more distance between the end tubes 26E and the next two end tubes 26N in order to accommodate a metallic cross brace 34 shown broken away and in cross section in FIG. 9. A similar cross brace 34 would also be disposed between the left end tubes 26E and the tubes 26N next to the left end tubes, this having been left off the left side for simplicity.

It should be noted that the front plate 22 is considered to be at the "front" of the base 14 in that it is closest to the nose or tip of the projectiles 16 (refer back momentarily to FIG. 3). Likewise, the back 30 of the tubes 26 is considered to be "back" because it is towards the back of the projectile 16. As used throughout this application, "front" and "back" shall be defined with reference to the tip and tail respectively of the projectiles. Thus, in FIG. 3, the base 14 is sitting upon its back.

Figure 9:
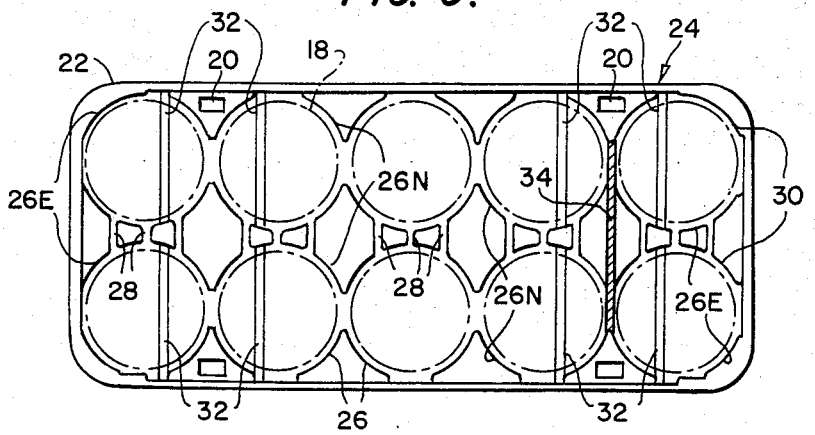
FIG. 9 shows a bottom view of the inner shell used for the base of the present invention.

Turning now to FIG. 4, it will be noted that the cross braces 34, one of which was partially shown in cross-section in FIG. 9, are part of a metal frame 36 which also includes a front peripheral rectangular reinforcing member 38 and a back peripheral reinforcing member 40. Each of the reinforcing members 38 and 40 connect to identically constructed reinforcing structures including the cross braces 34 extending between securing channel portions 42 connected by back pieces 44. The back reinforcing rectangular member 40 may be welded to the back pieces 44.

Each of the identically constructed securing channel portions 42 includes an opening 46 and slide portions 48 with projecting portions 50 disposed therebetween.

As shown in FIG. 4, the base 14 further includes an outer plastic molding 52 having slots 54 disposed therein, both sides of the slots 54 including channels 56 into which the slide portions 58 of metal frame 36 may be disposed. The front (i.e., top in FIG. 4) of the outer molding 52 includes a peripherally extending channel 58 into which the peripherally extending front reinforcing member 38 may be disposed. The back 60 (bottom in FIG. 4) of the outer molding 52 may include two slots 62 for accommodating the tines of a fork slift. Additionally, two slots 64 may be included for use with particular types of slings wherein a cable is extended underneath the object to be lifted.

Figure 5:
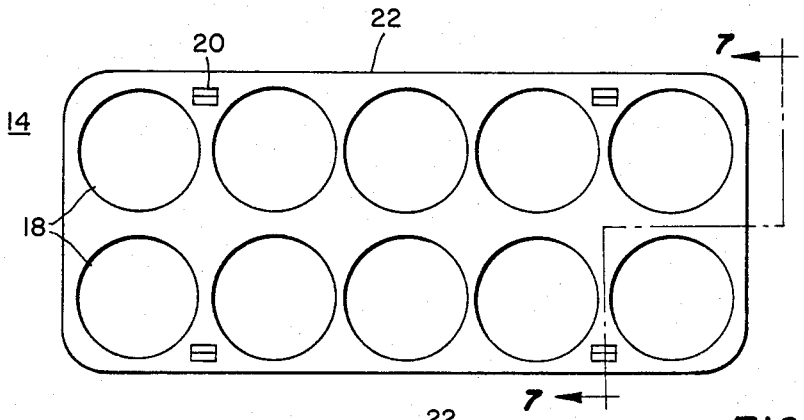
FIG. 5 shows a top view of the base of the present invention.
Figure 6:
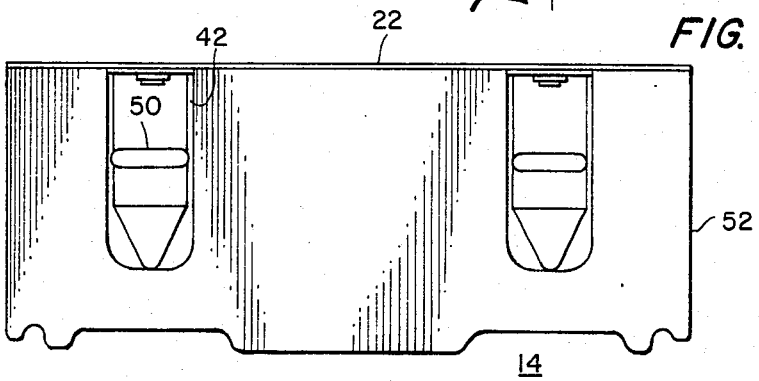
FIG. 6 shows a side of the base.

Considering now FIGS. 5–9 in conjunction with FIG. 4, the steps of construction for the base 14 of the present invention will be discussed. FIG. 5 shows a front view of the base 14 of the present invention, whereas FIG. 6 shows a side view of the base. FIG. 7 shows a partial cross-section view taken along lines 7—7 of FIG. 5. FIG. 8 shows a cross-section view taken along lines 8—8 of FIG. 7. FIG. 9 shows a back view of the plastic inner molding 24 with one of the cross braces 34 of metallic frame 36 shown in cross-section and broken away. The metallic frame 36 is slid into the outer molding 52 with slide portions 48 seating within the slot channels 56 of the slots 54. At the same time, the front peripheral reinforcing rectangular member 38 will seat within the peripheral channel 58 of the outer molding 52. The projecting portions 50 help center the securing channel portions 42 within the slots 54. There may be two projecting portions 50 (as shown in FIG. 4) for each securing channel portion 52 or, alternately as shown in FIG. 6, each securing channel portion 42 may include a single projecting portion 50.

The inner plastic molding 24 may then be slid into the outer plastic molding 52 with the metal frame 36 disposed therebetween. In particular, the cross braces 34 are slid between the end tubes 26E (see especially FIG. 9) and the next two end tubes 36N in the manner shown for the right cross brace 34 in FIG. 9. The front plate 22 of the inner molding 24 will then cover the channel 58 in which the peripheral metal reinforcing member 38 will be trapped. The back pieces 44 may include upwardly turned flanges at their edges (not shown) which seat within the channels 32 (see especially FIG. 9) on the back of the inner molding 24. The inner plastic molding 24 may then be plastic welded to the outer plastic molding 52 as, for example, around the edges of the front plate 22. Additionally, if desired, a part of the inner molding 24 (not shown) could extend through a hole in the back 60 to provide an additional point for plastic welding.

Figure 10:
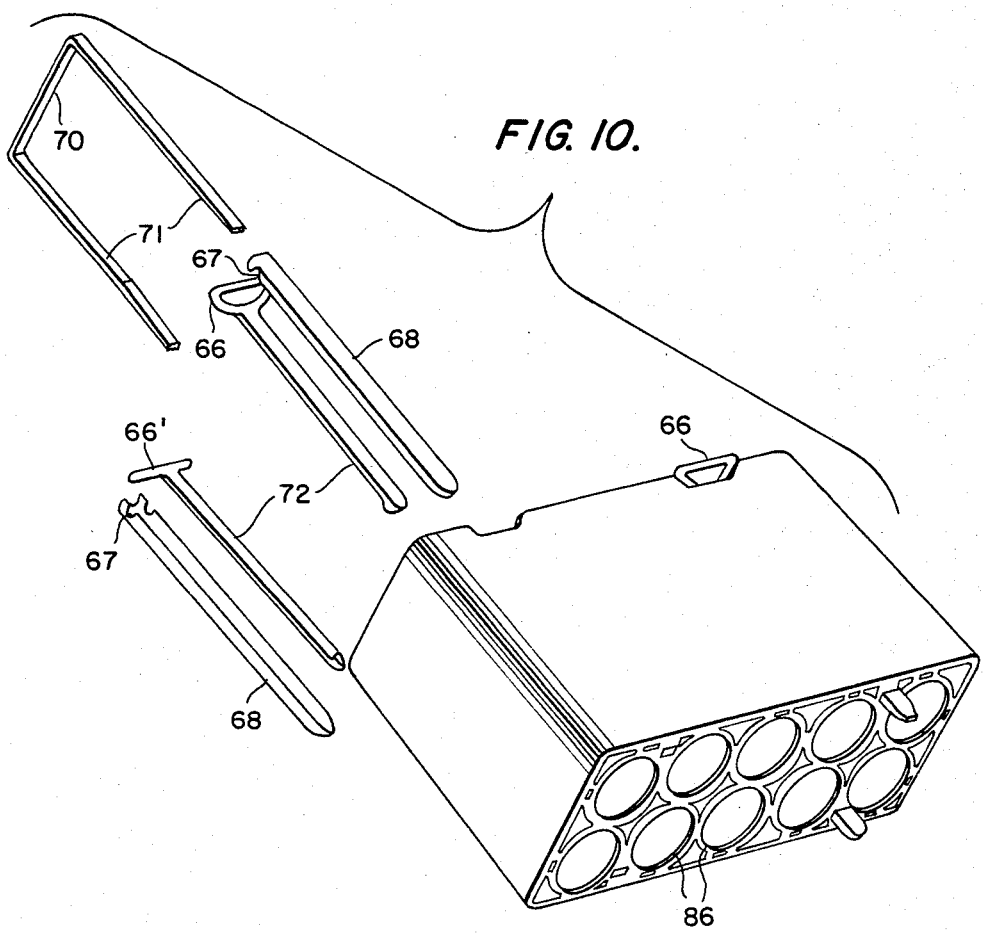
FIG. 10 shows an exploded view of parts of the cover of the present battlefield magazine.

Considering now FIGS. 10–12 in conjunction with FIG. 1, the details of construction of the cover 12 of the present invention will be discussed in detail. FIG. 10 shows a perspective view with some parts removed from the cover 12, whereas FIGS. 11 and 12 show cross-section sequence partial views illustrating how the cover 12 is attached to the base 14 with a projectile 16 disposed therebetween.

The cover 12 includes a plurality of lift bar weldments 66 which are attached to the lock bars 72 and trapped within a notch 67 in the channel weldments 68. Instead of including a lift bar weldment such as 66, the lock bar 72 might simply have a locking transverse portion 66' (as per left side of FIG. 10 only). In either case, the lock bar 72 would be secured against sliding movement relative to the channel weldment 68. A control strap 70 includes slanted camming surfaces 71 as best seen in FIG. 10.

Figure 11:
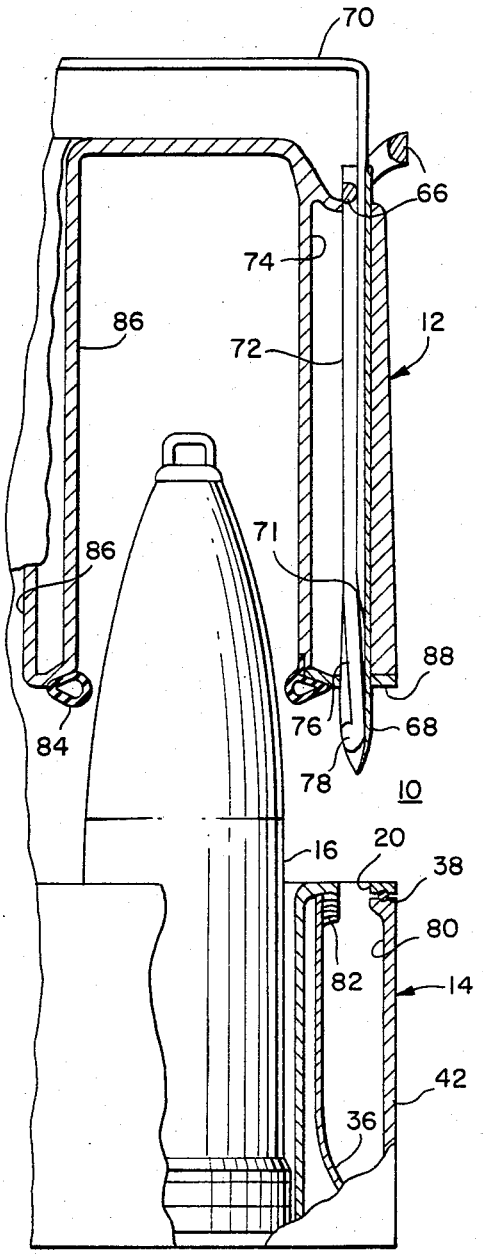
FIG. 11 shows a partial cross-section side view of the cover and the base of the battlefield magazine prior to their attachment together.
Figure 12:
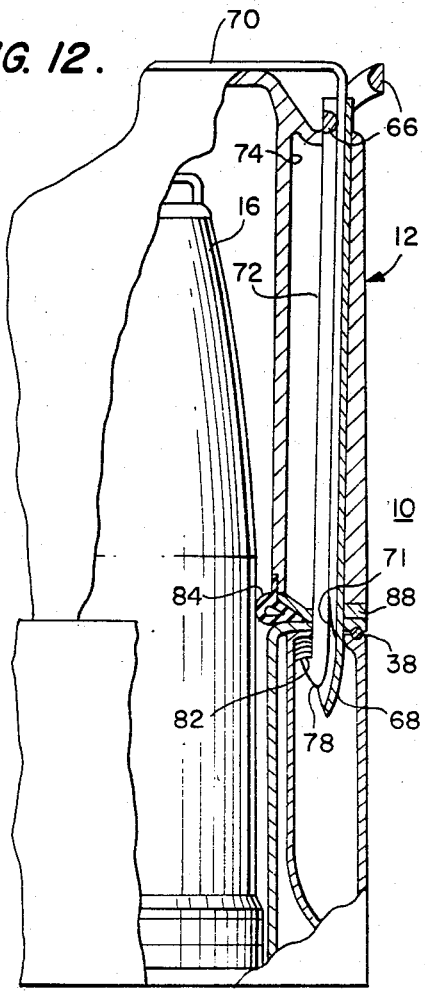
FIG. 12 shows a partial cross-section side view of the cover and base together.

As shown in FIG. 11, the parts 66, 68, 70, and 72 are mounted within a channel 74 in the side of the cover 12. Together, these parts may be considered as a back securing means in that they secure a back (i.e., the base 14) to the cover 12. The lock bar 72 is slanted outwardly at 76 down to a locking part 78. When the control strap 70 is in the position shown in FIG. 11, the cover 12 may inserted over the base 14 with the part 78 and tip of channel weldment 68 extending through the hole 20 into a securing chamber 80 within the securing channel portion 42 of the metal frame 36. A metallic block or stop 82 is also disposed within the chamber 80.

When the cover 12 is brought into contact with the base 14, a plurality of resilient circular seals 84 will be compressed therebetween. Each of the resilient seals 84 corresponds on a one-to-one basis with a projectile front storage zone defined by cylindrical front storage tubes 86 which are connected by webbing as shown in FIG. 10. FIG. 11 shows only a single annular seal 84 which is disposed upon a back panel 88. For ease of illustration, the back panel 88 and the seals 84 are not shown in the perspective view of FIG. 10. As will be readily appreciated, there is one projectile front storage cylindrical tube 86 for each of the projectiles 16 which may have their backs or tail sections disposed within an associated projectile back storage zone or compartment defined by the cylindrical tubes 26 (refer back momentarily to FIG. 4).

When the cover 12 has been placed into contact with the base 14 such that each of the seals 84 is compressed therebetween, the cover 12 may be secured to the base 14 by pushing the control straps 70 downward. This in turn moves the camming surface 71 down and pushes out on the lower slanted portion 76 of the lock bar 72 such that the lock part 78 is moved into solid contact with the securing block 82 in the securing chamber 80 of the base 42. This is the position shown in FIG. 12. Note that lifting the projectile storage container 10 formed by the cover 12 and the base 14 by way of the lifting bar weldments 66 will be transmitted directly to the securing block 82, thus maintaining the strong connection between the cover 12 and base 14.

An alternate (not shown) to the arrangement of camming surface 71 of strap 70 and slanted portion 76 of lock bar 72 could use a straight lock bar and strap with push-out blocks in place of cam surfaces 71, the push-out blocks increasing the separation between the lower ends of part 72 and channel 68 to lock the cover in place.

The resilient seals 84 are useful to avoid long term deterioration of the projectile 16 as may be caused by harsh environmental conditions such as high humidity. By separately sealing each of the projectiles 16 (an annular seal 84 is included for each of the projectile front storage tubes 86) moisture which might accidentally have been trapped within one of the projectile storage zones defined by the front projectile storage tubes 86 together with the corresponding back projectile storage tube 26 would only be able to damage the particular projectile having the moisture trapped in its chamber. That is, each projectile has a separate chamber isolated from each other projectile chamber.

The resilient seals 84 are not only very useful for protecting the projectile 16 against deterioration under long term storage conditions, but also serve to protect the projectiles against nuclear, biological, and chemical agents. That is, the projectiles 16 would be sealed against contamination due to chemicals, biological agents, or radioactive fall-out contacting their surfaces. Because the outside of the projectile storage container 10 comprised of cover 12 and base 14 is relatively smooth, it may be decontaminated in relatively simple fashion, instead of having to decontaminate each projectile individually.

The resilient seals 84 are additionally useful in that they press against the projectile 16 (as best shown in FIG. 12) to maintain the projectile 16 against slight movements within the projectile storage container 10.

The parts of cover 12 and base 14 except for metallic parts 36, 66, 68, 70, 72, and 82 may be made of high density polyethylene, although other plastics might be used.

The securing chamber 80 and securing block 82 function as a front securing means on the base 14 in that they allow the base 14 to have a front piece removably attached thereto.

Cover 12 can be removed from base 14 by pulling the control straps 70 upwardly to their position of FIG. 11. Fist-accommodating recesses 77 (FIG. 1) allow one to pull the control straps 70 up and cause lock portion 78 to clear block 82 (FIGS. 11 and 12).

Figure 14:
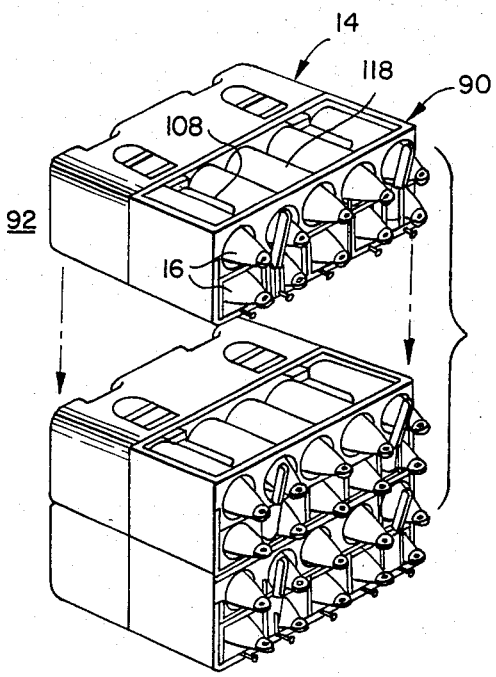
FIG. 14 shows the base and projectile locking front in assembled condition and about to be attached to two other base/locking unit assemblies.

Turning now to FIGS. 13, 14, 15, and 16, the projectile locking front 90 of the present invention will be discussed in detail. As illustrated by the arrows in FIG. 13, the projectile locking front 90 may be alternately placed over the base 14 when the cover 12 has been removed therefrom. Together, the base 14 and projectile locking front 90 comprise a projectile locking rack which, as shown in FIG. 14 may be stacked one on top of the another with access to the front or nose of the projectiles 16.

Figure 16:
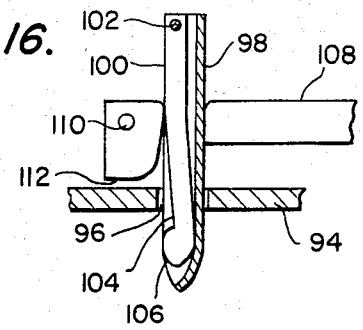
FIG. 16 shows back securing arrangement which may be used with the present invention.

The projectile locking front 90 may attach to the base 14 in any of numerous ways. Preferably however, the projectile locking front 90 may include a back securing means operating on the same basic principles as those used by the lock bar 72 (see especially FIGS. 11 and 12) as used with the cover 12. One possible arrangement is shown in FIG. 16 which is a simplified detail view showing the back plate 94 of the projectile locking front 90 having a hole 96 disposed therein through which a channel weldment 98 and locking bar 100 extend. The locking bar 100 includes a transverse bar 102 (similar to 66' in FIG. 10) trapped in a notch within the channel weldment 98. Additionally, the transverse bar 102 may extend to a boss or bosses (not shown) extending up from the back plate 94, thereby securing the channel weldment 98 and lock bar 100 to the projectile locking front 90. The lower portion of the lock bar 100 includes a slanted portion 104 and lock part 106 having similar functions to the respective slanted portion 76 and lock part 78 used in FIG. 11 and FIG. 12. A control lever 108 is pivotably mounted at point 110 to the boss or bosses (not shown) extending upwardly from the back plate 94. Adjacent the pivot point 110, the lever 108 includes a cam surface 112. When the control lever 108 lies in its deactivation position generally parallel to back plate 94 (FIGS. 13 and 16), the cam 112 allows the lock bar 100 and channel weldment 98 to be disposed within the securing chamber 80 (refer back to FIGS. 11 and 12). When the control lever 108 is rotated to be generally perpendicular to the back plate 94 (see FIG. 14) this causes cam surface 112 to straighten out the lock bar 100 such that lock bar 100 and channel weldment 98 will have relative positions similar to that of lock bar 72 and channel weldment 68 in FIG. 12. Accordingly, rotating the control lever 108 upwards will lock the projectile locking front 90 to the base 14. The cam 112 could be integral with the control lever 108 or, alternately, could be a separate cam fixed to rotate with the control lever 108. All four levers 108 (FIG. 13 and FIG. 14) should be rotated up to lock the front 90 to base 14.

Although a specific construction for the projectile locking mechanisms used with the projectile locking front 90 will be presented herein, the specifics of the locking arrangement are described in detail in U.S. Pat. application No. 643,269 filed Aug. 22, 1984 of Bruce S. Johnson concurrently herewith, entitled SPIRAL BAND LOCKING MECHANISM, and assigned to the assignee of the present invention. That application, which is hereby incorporated by reference, discloses and claims the specifics for the locking mechanisms illustrated in FIG. 15 of the present application. Of course, the concept of using a relatively inexpensive cover for long term storage and normal transportation of projectiles and replacing the relatively inexpensive cover with a separate locking front using a common base is broadly applicable regardless of the specific projectile locking mechanisms used. For example, the control rod and cam locking arrangement used in the Perisastry et al. U.S. Pat. No. 4,344,528 could be adapted for use with the present invention by shortening the cylindrical tubes, opening the backs of the cylindrical tubes, and modifiying the Perisastry et al. structure so as to allow it to be bolted or otherwise secured to the base of the present invention.

The projectile locking front 90 includes a front plate 114, the back plate 94, and two side plates 116 extending therebetween. Additionally, a two-by-five array of cylindrical projectile front storage tubes 118 extend between the front plate 114 and the back plate 94. Each of the cylindrical tubes is open at both of its ends and defines a projectile front storage zone or compartment therein.

Figure 15:
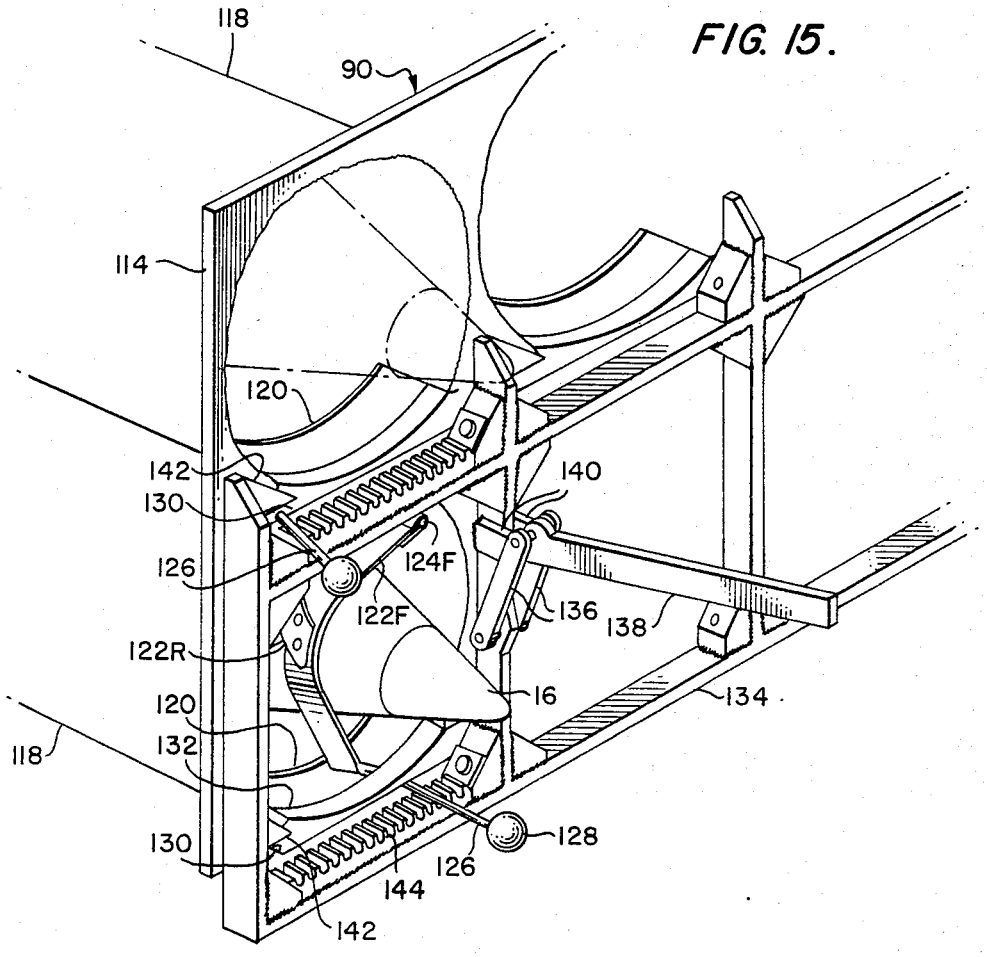
FIG. 15 shows a perspective view of a locking arrangement which may be used with the present invention.

As best shown in the detailed simplified perspective of FIG. 15, the front storage tubes 118 are welded to the back of the front plate 114 and include an arcuate slot 120 in between the lower front part of the tubes 118 and the front plate 114. A securing portion steel band comprising connected parts 122F and 122R is fixed to a pin 124F. The rear steel band portion 122R would likewise be fixed at its back end to a similar pin or mounting point (not shown). Preferably, the rear steel band portion 122R is arranged to extend in spiral fashion around the projectile 16. The front band portion 122F is connected to a spring-loaded release lever or rod controller 126 which may, for example, be spring-biased by its own resilience. The release lever 126 is biased towards the right side (with respect to FIG. 15) of the projectile locking front 90. Accordingly, the release lever 126 normally pulls the steel band portions 122F and 122R into the securing position shown at the bottom of FIG. 15 whereby the steel band portions prevent the projectile 16 from moving out of the front of the projectile locking front 90. In order to allow removal of the projectile 16, the release lever 126 is manually operated by knob 128 to be slid leftwardly and hooked onto a notch 130 which secures the spring biased release rod 126 against rightward movement. The notch 130 is disposed in a piece 132 which is welded or otherwise fixed to the front plate 114. When the release rod 126 is disposed in its far leftward position and locked into the notch 130 as shown for the top release rod 126 in FIG. 15, the steel band portions 122F and 122R will likewise be moved leftwardly (not shown in the top of FIG. 15) such that a projectile may be moved in or out of the associated projectile storage tube 118.

A latching frame assembly 134 includes links 136 pivotably attaching it to a release lever 138. The release lever 138 is in turn mounted to flanges 140 extending out from the front of the projectile locking front 90. The release lever 138 is attached in an overtoggle fashion such that moving it up and down will likewise slide the release frame assembly 138 up and down. The release frame assembly further includes a number of fingers 142 and serrated portions 144. For simplicity of illustration, the steel bands 122F and 122R, spring release rods 126 serrated portions 144 and fingers 142 are not shown for each of the projectile storage tubes 118, although it will be readily appreciated that each of these storage tubes 118 has a corresponding one of these parts associated with it. Although FIG. 15 only shows the left side release lever 138, it will be readily appreciated that a right side release lever (also 138 in FIG. 13) is preferably used as well.

The operation of the spring release rod 126 in conjunction with the release frame assembly 134 is relatively straightforward. In the closed and unlocked position as shown at the bottom of FIG. 15, the spring release rod 126 is held by spring tension such that the steel band 122F and 122R wrap around the ogive of the projectile. The release lever 138 is disposed in its middle position as shown in FIG. 15 such that the release frame assembly 134 disposed so that spring release rod 126 is above the serrated portion 124. This is the normal position of the mechanism and is used to hold the projectiles in the rack when the vehicle is stopped and preparing to load or unload.

From the position shown at the bottom of FIG. 15, the spring release rod 126 may simply be slid leftwardly and latched to the notch 130 to the position shown at the top of FIG. 15 such that a projectile may be loaded or unloaded from the corresponding projectile storage tube 118.

In order to gang lock all of the projectiles within their corresponding projectile front storage tubes 118, the levers 138 are moved downwardly causing the release frame assembly 134 to likewise move to its down most position. This causes the fingers 142 on the release frame assembly 134 to move downwardly and release any of the spring release rods 126 which are being held within the corresponding notches 130. Thus, from the position shown in FIG. 15, the top release rod 126 will be pushed out of the top notch 130 by the top finger 142. The spring bias of the rod 126 will then move it leftwardly against any projectile disposed within that corresponding storage tube 118. Thus, with the release levers 138 in their down-most positions and the release frame assembly likewise in its down position, all of the projectile storage tubes will be closed with the spring-bias of release rods 126 causing the steel bands 122R and 122F to secure the corresponding projectiles. This closed position will generally hold the projectiles in place. However, if the vehicle in which the projectile locking front 90 is disposed is going to be moved rapidly, it is preferable to lock all of the projectiles in place by moving the release levers 138 to their upper most positions such that the release frame assembly 134 is likewise in its upper most position. In this upper position with the release levers 138 generally vertical, the serrated portions 144 will be moved sufficiently upwardly so as to trap the corresponding spring release rod 126. The release rod 126 may not be moved with the release lever 138 in its upper most position, because attempts to move the release rod 126 upwardly and out of the serrated portion 144 will be blocked by the part 132. Accordingly, each of the projectiles 16 will not only be closed or held in the corresponding projectile storage tube 118 by the spring force of release rod 126, but will additionally be mechanically blocked by the serrated portions 144.

When it is desirable to unlock the projectiles, the release levers 138 may simply be pivoted downward to the neutral position shown in FIG. 15, whereupon the individual release rods 126 may be used to separately open and close each of the projectile storage tubes 118.

It should be noted that the use of a plurality of serrations as with serrated portion 144 allows the projectile locking front 90 to accommodate various sizes of projectiles. Depending upon the particular length and diameter (minor variations in diameter could be accommodated) of the projectiles, the spring release rod 126 would lock the projectiles in place by seating within different of the serrations in serrated portion 144.

The overall use of the present invention is relatively straightforward. Projectiles 16 may be placed within the base 14 (referring back to FIGS. 1–3) and the cover 12 may be attached thereto. The projectiles will be safe from nuclear, chemical, and biological agents and will be protected against harsh environmental conditions. The projectiles may be transported in the projectile container 10 to a place or vehicle whereat the projectiles will be used. Instead of having to remove the projectiles from the projectile storage container 10, the cover 12 may simply be removed and replaced by the alternate projectile front protecting device 90 as shown in FIG. 13. Once the projectiles are secured within the projectile locking rack 92 made from the assembly of projectile locking front 90 onto base 14, the projectile locking rack 92 may be placed upon similar locking racks as shown in FIG. 14. Mating lugs and channels (not shown) or other techniques may be used for stacking the racks in similar fashion to the stack accommodating features of the Perisastry et al. patent. Referring to FIG. 15, each of the projectile storage compartments comprising the projectile front storage tubes 118 and corresponding projectile back storage compartment defined by tubes 26 (FIG. 4) may be individually opened or closed by use of the spring release rods 126. If necessary to move the vehicle in which the rack 92 is disposed, the release levers 138 may be used to quickly lock all of the projectiles in place.

The parts of the projectile locking front 90 are preferably made of metal, although other materials could also be used.

Although specific details have been disclosed herein, it is to be understood that these are for illustrative purposes only. Various modifications and adaptations will be apparent to those of ordinary skill in the art. Accordingly, the scope of the present invention should be determined by reference to the claims appended hereto.

What is claimed is:

1. An apparatus comprising a projectile locking front including:

(a) a body having a front and a back;

(b) a plurality of projectile front storage zones in said body and extending from said back to said front, each of said front storage zones having an open back to allow projectiles to extend outwardly therefrom and an open front to allow projectiles to extend outwardly therefrom;

(c) locking means mounted to said body and selectively operable to secure projectiles against movement out the front of said storage zones and selectively operable to allow projectile removal out of the front of said front storage zones; and (d) base securing means on said body operable for removably securing a base to said back of said body, the base having a plurality of projectile back storage zones associated on a one-to-one basis with said front storage zones and operable to hold the backs of projectiles which have their noses extending into said projectile front storage zones.

2. The apparatus of claim 1 wherein each of said front storage zones is within a corresponding front storage tube.

3. The apparatus of claim 1 wherein said locking means includes a securing portion for each of said front storage zones, each securing portion selectively operable to prevent a projectile from moving out of one of said front storage zones.

4. The apparatus of claim 1 further comprising a base for holding back portions of a plurality of projectiles and including:

a back;

a front parallel to said back of said base and having a plurality of projectile openings therein;

four sides extending from said back of said base to said front of said base; and a plurality of separate projectile back storage zones between said front of said base and said back of said base, said back storage zones associated on a one-to-one basis with said projectile openings; and wherein said base is removably secured to said locking front by said base securing means.

5. The apparatus of claim 4 wherein each of said back storage zones has a length and transverse dimension to be operable to hold a projectile with at least one-half of the ogive of the projectile extending out from said front of said base.

6. The apparatus of claim 4 wherein said base further comprises securing means operable for removably securing a projectile front protecting device to said front of said base; and wherein said base is operable to secure alternate projectile front protecting devices to said front of said base; one of said front protecting devices being a cover which encloses at least the front one-half of the ogives of projectiles extending out of said back storage zones, and wherein movement of all of the cover is necessary to allow removal of projectiles from said back storage zones; the other of said front projecting devices being said projectile locking front.

7. The apparatus of claim 6 wherein said base and the cover are together operable to compress at least one resilient seal disposed therebetween and to protect a plurality of projectiles against nuclear, biological, and chemical agents.

8. The apparatus of claim 4 wherein each of said back storage zones is isolated from the other back storage zones.

9. The apparatus of claim 4 wherein said base includes a plastic outer molding, a plastic inner molding, and a metal insert frame in between said plastic outer molding and said plastic inner molding; and wherein said plastic inner molding has a plurality of tubes each of which defines one of said back storage zones.

10. An apparatus comprising a base for holding back portions of a plurality of projectiles and including:

(a) a back;

(b) a front parallel to said back and having a plurality of projectile openings therein;

(c) four sides extending from said back of said base to said front of said base;

(d) a plurality of separate projectile back storage compartments between said front of said base and said back of said base with parallel center lines, said projectile back storage compartments associated on a one-to-one basis with said projectile openings and each having a length and transverse dimension to be operable to hold a projectile with at least one-half of the ogive of the projectile extending out from said front of said base; and (e) front securing means operable for removably securing a projectile front protecting device to said front of said base; and wherein said base is operable to secure alternate projectile front protecting devices to said front of said base; one of said front protecting devices being a cover which encloses at least the front one-half of the ogives of projectiles extending out of said back storage compartments, said base and the cover are together operable to compress at least one resilient seal disposed therebetween and to protect a plurality of projectiles against nuclear, biological, and chemical agents, and wherein movement of all of the cover is necessary to allow removal of projectiles from said back storage compartments; the other of said front protecting devices being a projectile locking front having locking means selectively operable to secure projectiles against movement out of said back storage compartments and selectively operable to allow projectile removal from said back storage compartments with the projectile locking front disposed at said front of said base.

11. The apparatus of claim 10 wherein each of said back storage compartments is isolated from the other back storage compartments.

12. The apparatus of claim 10 wherein said base includes a plastic outer molding, a plastic inner molding, and a metal insert frame in between said plastic outer molding and said plastic inner molding; and wherein said plastic inner molding has a plurality of tubes each of which defines one of said back storage compartments.

13. The apparatus of claim 10 further comprising a cover operable to enclose at least the front one-half of ogives of projectiles extending out from said base and including:

a cover body having a closed off front, a back, four sides extending from said front to said back;

a plurality of projectile front storage zones disposed in said cover body and extending from said back of said cover body to said front of said cover body; and securing means operable with said front securing means for removably securing said cover to said base with said plurality of back storage compartments in said base associated on a one-to-one basis with said projectile front storage zones such that each projectile front storage zone may hold the front of a projectile having its back extending into the associated back storage compartment.

14. The apparatus of claim 13 further comprising a plurality of resilient seals disposed for compression between said cover and said base and associated on a one-to-one basis with said projectile openings; and wherein said each back storage compartment and associated front storage zone together define a projectile chamber isolated from other projectile chambers.

15. The apparatus of claim 13 wherein said cover further includes:

at least one control on said cover body operable for activating and deactivating said back securing means.

16. The apparatus of claim 10 further comprising a projectile locking front including:

a body having a front and a back;

a plurality of projectile front storage zones in said body and extending from said back to said front, each of said front storage zones having an open back to allow projectiles to extend outwardly therefrom and an open front to allow projectiles to extend outwardly therefrom;

locking means mounted to said body of said locking front and selectively operable to secure projectiles against movement out the front of said front storage zones and selectively operable to allow projectile removal out of the front of said projectile front storage zones; and base securing means on said body operable with said front securing means for removably securing said base to said back of said body of said locking front such that said back storage compartments correspond on a one-to-one basis with said front storage zones.

17. The apparatus of claim 16 wherein said locking means includes a securing portion for each of said front storage zones, each securing portion selectively operable to prevent a projectile from moving out of one of said front storage zones.

18. The apparatus of claim 17 wherein each of said front storage zones is within a corresponding front storage tube.

19. An apparatus comprising a cover operable to enclose at least the front one-half of the ogives of projectiles extending out from a base and including:

(a) a cover body having a closed off front, a back, four sides extending from said front to said back;

(b) a plurality of projectile front storage zones disposed in said cover body and extending from said back to said front;

(c) back securing means operable for removably securing said cover to the base with a plurality of projectile back storage compartments in the base corresponding on a one-to-one basis with said front storage zones such that each front storage zone may hold the front of a projectile having its back extending into the corresponding back storage compartment; and (d) at least one control on said cover body operable for activating and deactivating said back securing means; and wherein said cover and the base are together operable to compress at least one resilient seal disposed therebetween and to protect a plurality of projectiles against nuclear, biological, and chemical agents.

20. The apparatus of claim 19 further comprising a base for holding back portions of a plurality of projectiles and including:

a back;

a front parallel to said back of said base and having a plurality of projectile openings therein;

four sides extending from said back of said base to said front of said base;

a plurality of separate projectile back storage compartments between said front of said base and said back of said base with parallel center lines, said projectile back storage compartments associated on a one-to-one basis with said projectile openings and each having a length and transverse dimension to be operable to hold a projectile with at least one-half of the ogive of the projectile extending out from said front of said base; and front securing means operable with said back securing means for removably securing said cover to said front of said base.

21. The apparatus of claim 20 wherein said base is operable to secure alternate projectile front protecting devices to said front of said base; one of said front projecting devices being said cover; the other of said front protecting devices being a projectile locking front having locking means selectively operable to secure projectiles against movement out of said projectile back storage compartments and selectively operable to allow projectile removal from said projectile back storage compartments with the projectile locking front disposed at said front of said base.

22. A method for storing projectiles and making projectiles accessible for usage, the steps comprising:

I. placing a plurality of projectiles in a projectile container having a base and a cover, said base including:

a back;

a front parallel to said back and having a plurality of projectile openings therein;

four sides extending from said back of said base to said front of said base;

a plurality of separate projectile back storage zones between said front of said base and said back of said base with parallel center lines, said projectile back storage zones associated on a one-to-one basis with said projectile openings; and front securing means operable for removably securing a projectile front protecting device to said front of said base; and said cover including:

a cover body having a closed off front, a back, four sides extending from said front of said cover body to said back of said cover body;

a plurality of projectile front storage zones disposed in said cover body and extending from said back of said cover body to said front of said cover body;

back securing means operable with said front securing means for removably securing said cover to the base with said plurality of projectile back storage zones in the base corresponding on a one-to-one basis with said front storage zones with each projectile having its back disposed in one of said projectile back storage zones and its front disposed in the corresponding front storage zone; and wherein said projectiles are inaccessible with said cover on said front of said base; and II. removing said cover when said projectiles are to be made ready for access; and III. securing a projectile locking front to said base, said projectile locking front including:

a body having a front and a back;

a plurality of projectile front storage zones in said body corresponding on a one-to-one basis with said projectile back storage zones and extending from said back to said front, each of said front storage zones in said projectile locking front having an open back to allow projectiles to extend outwardly therefrom and an open front to allow projectiles to extend outwardly therefrom;

locking means mounted to said body and selectively operable to secure projectiles against movement out the front of said front storage zones in said projectile locking front and selectively operable to allow projectile removal out of the front of said front storage zones in said projectile locking front; and base securing means on said body operable for removably securing said base to said back of said body; and wherein said projectile locking front allows access and removal of said projectiles while it is secured to said base.

23. The method of claim 22 wherein said cover and the base are together operable to compress at least one resilient seal disposed therebetween and to protect the plurality of stored projectiles against nuclear, biological, and chemical agents.

24. The method of claim 22 wherein said cover further includes at least one control on said cover body operable for activating and deactivating said back securing means.

25. The method of claim 22 wherein each of said projectile front storage zones of said projectile locking front is within a corresponding front storage tube.

26. The method of claim 22 wherein said locking means includes a securing portion for each of said front storage zones, each securing portion selectively operable to prevent a projectile from moving out of said front storage zones of said projectile locking front.

27. The method of claim 22 wherein at least one-half of the ogives of the stored projectiles project frontwardly out from the base.

* * * * *